US010838367B2

(12) United States Patent
Bonke

(10) Patent No.: US 10,838,367 B2
(45) Date of Patent: Nov. 17, 2020

(54) WATCH GLASS WITH AT LEAST ONE GEMSTONE

(71) Applicant: Levitation AG, Zug (CH)

(72) Inventor: Michael Bonke, Oberwil bei Zug (CH)

(73) Assignee: LEVITATION AG, Zug (CH)

( * ) Notice: Subject to any disclaimer, the term of this patent is extended or adjusted under 35 U.S.C. 154(b) by 0 days.

(21) Appl. No.: 15/566,087

(22) PCT Filed: Jun. 30, 2015

(86) PCT No.: PCT/EP2015/064840
§ 371 (c)(1),
(2) Date: Oct. 12, 2017

(87) PCT Pub. No.: WO2016/165787
PCT Pub. Date: Oct. 20, 2016

(65) Prior Publication Data

US 2018/0113422 A1 Apr. 26, 2018

(30) Foreign Application Priority Data

Apr. 17, 2015 (DE) ..... 10 2015 207 049

(51) Int. Cl.
*G04B 47/04* (2006.01)
*A44C 17/04* (2006.01)
*G04B 39/02* (2006.01)

(52) U.S. Cl.
CPC ..... *G04B 47/042* (2013.01); *A44C 17/04* (2013.01); *G04B 39/02* (2013.01)

(58) Field of Classification Search
CPC ..... G04B 47/042; G04B 39/02; G04B 47/04; G04C 27/10; A44C 5/003
See application file for complete search history.

(56) References Cited

U.S. PATENT DOCUMENTS 2,109,376 A 2/1938 Reilly
2,666,306 A * 1/1954 Lewis ..... A44C 17/04 63/15
2,756,571 A * 7/1956 Niven ..... A44C 17/04 63/15
2,756,572 A * 7/1956 Yeager ..... A44C 17/04 29/512

(Continued)

FOREIGN PATENT DOCUMENTS

DE 20304692 8/2003
EP 0277510 8/1988

(Continued)

OTHER PUBLICATIONS

Rivet—merriam-webster.com/dictionary/rivet—2014.*

(Continued)

*Primary Examiner* — Sean Kayes
(74) *Attorney, Agent, or Firm* — Michael Best & Friedrich LLP

(57) ABSTRACT

The invention relates to a watch, comprising a gemstone, a setting, which has a pin-shaped projection and in which the gemstone is accommodated, and a watch glass including a continuous recess which at least the pin-shaped projection of the setting is arranged, the pin-shaped projection being fastened to the watch glass.

24 Claims, 5 Drawing Sheets

(56) References Cited

U.S. PATENT DOCUMENTS

| | | | | | |
|---|---|---|---|---|---|
| 4,674,892 | A * | 6/1987 | Loth | G04B 39/02 | 368/280 |
| 4,800,738 | A * | 1/1989 | Bunz | A44C 17/005 | 63/26 |
| 5,400,304 | A * | 3/1995 | Offenstein | G04B 19/106 | 368/281 |
| 5,765,398 | A * | 6/1998 | Bardisbanyan | A44C 17/046 | 29/10 |
| 8,974,113 | B1 * | 3/2015 | Chan | G04B 45/0076 | 368/285 |
| 2003/0081508 | A1 * | 5/2003 | Tardy | G04B 39/00 | 368/283 |
| 2009/0071193 | A1 * | 3/2009 | Ionescu | A44C 17/005 | 63/28 |

FOREIGN PATENT DOCUMENTS

| | | |
|---|---|---|
| FR | 2299830 | 9/1976 |
| JP | 2008089533 | 4/2008 |

OTHER PUBLICATIONS

International Search Report for Application No. PCT/EP2015/064840 dated Nov. 3, 2015 (English Translation, 3 pages).

* cited by examiner

WATCH GLASS WITH AT LEAST ONE GEMSTONE

FIELD OF THE INVENTION

The invention relates to a watch glass with at least one gemstone, such as for example a diamond or other precious stone. The present invention also relates to a watch which comprises a watch glass of said type.

BACKGROUND OF THE INVENTION

Watch glasses with gemstones or precious stones are well known. For example, such a watch glass is produced from two glasses connected to one another, wherein the gemstones are in each case inserted in one recess of the watch glass. Here, the thickness of the fully manufactured watch glass depends on the size of the gemstone. In the case of particularly large gemstones, the watch glass is of very thick form, which can lead to a massive and not very elegant watch. Furthermore, the production process for a watch glass composed of two glasses can be cumbersome and expensive.

SUMMARY OF THE INVENTION

It is the object of the invention to propose a watch glass with at least one gemstone, which watch glass can be produced in a cost-effective and simple manner.

Said object is achieved by the feature combination of claim 1. The dependent claims show preferred refinements of the invention.

According to the invention, a watch is proposed, which has a gemstone, a setting which has a pin-shaped projection and in which the gemstone is accommodated, and a watch glass including a continuous recess in which at least the pin-shaped projection of the setting is arranged, wherein the pin-shaped projection is fastened to the watch glass.

Consequently, the placement of the gemstones is made possible in a simpler and more cost-effective manner than in the case of watch glasses in which the gemstones are arranged between two watch glasses connected to one another. A further advantage of the present invention is that the watch glass may be of relatively thin form, which means that a watch may be considerably flatter. This yields additional possibilities in the design and also another visual impression of a watch.

Furthermore, it is possible, for example in the case of curved or not absolutely flat glasses, for the placement of the gemstones to take place without difficulty.

Moreover, the provision of a continuous recess allows the placement of the setting with the gemstone and the connection to the watch glass to be carried out in a simpler manner, since access to the recess is possible from both sides of the watch glass. Also, a continuous recess can be produced in a simpler and more cost-effective manner than, for example, a blind hole.

The watch glass may advantageously be produced from sapphire glass, which is harder and more scratch resistant than other glass types.

The recess is formed in particular as a bore of circular cross section. However, in the context of the invention, the recess can have other shapes, such as for example the shape of a rectangle. Correspondingly, the pin-shaped projection preferably has a circular cross section, although other shapes are equally conceivable in the context of the invention.

The dependent claims show preferred refinements of the invention.

Preferably, the pin-shaped projection of the setting extends beyond a bottom side of the watch glass. There is thus a more secure connection of the projection to the watch glass via a relatively large common contact surface.

According to a preferred configuration of the invention, the pin-shaped projection of the setting is riveted. In this case, the pin-shaped region of the setting serves as a rivet in which a rivet head is formed at the end of the pin-shaped projection. Due to the riveting, a form-fitting connection between the recess and the projection is realized. For the purpose of riveting, the setting and the pin-shaped projection may preferably be pressed together. This can lead to bulging of the pin-shaped projection, which gives rise to an additional force-fitting connection of the projection to the recess.

According to the invention, as an alternative or additionally to the riveting of the pin-shaped projection, the pin-shaped projection of the setting may be connected in a materially-bonded manner, particularly preferably adhesively bonded, to the watch glass. An adhesive bond provides a simple and cost-effective possibility for fastening the parts to one another. The advantage of an adhesive bond in combination with a continuous recess in the watch glass is that a relatively large adhesion surface is available between the projection and the watch glass.

The setting is preferably arranged at least partially on a surface of the watch glass. This gives rise to a high-quality optical effect since the gemstone is located on the surface of the watch glass. In particular if the watch glass is viewed from a shallow viewing angle, it is possible, depending on the design of the setting, for the gemstone to be visible from the side. If the gemstone is arranged on the surface of the watch glass, the gemstone is much more prominent and dominates the watch. If the gemstone is left in the recess such that the upper part of the gemstone is located above the surface of the watch glass, a more elegant optical effect combined with a compact structure of the watch glass is achieved.

According to a further preferred configuration of the invention, the recess has a first cross-sectional region and at least one second cross-sectional region, wherein the first cross-sectional region has an essentially larger cross section than the second cross-sectional region. Due to the provision of the first cross-sectional region, it is possible for the setting to be arranged in the recess in a stable manner.

Particularly preferably, the first cross-sectional region is of tapered or conical form, whereas the second cross-sectional area is of pin-shaped form. Such a recess can be realized in a quick, cost-saving and precise manner. Also, the recess may advantageously accommodate a funnel-shaped setting. As a result of the form according to the invention of the recess, the direction of insertion of the setting is predefined, and this facilitates the positioning of the setting in the recess.

It is also advantageous if the setting is arranged at least partially in the first cross-sectional region of the recess, and if the pin-shaped projection is arranged at least partially in the second cross-sectional region of the recess. It is thus possible for the setting to be sunk at least partially with respect to the surface of the watch glass. As a result, the tip of the gemstone can project into the watch glass, and the gemstone is not seated as high above the watch glass. This allows the use of larger gemstones in the watch glass without the overall thickness of the watch being increased.

According to the invention, the first cross-sectional region may be arranged on the surface or on the bottom side of the watch glass. This consequently allows flexibility during the fastening of the setting to the watch glass and in the design of the setting. If the first cross-sectional region is formed on the bottom side of the watch glass, the advantage is that the pin-shaped projection can be riveted without the projection projecting beyond the bottom side of the watch glass. The watch glass may therefore be of a flatter form.

According to the invention, the setting may have a plurality of pin-shaped projections, and the watch glass may have a plurality of recesses, wherein the pin-shaped projections are in each case arranged in one recess of the plurality of recesses. Thus, the watch glass may be provided with relatively large gemstones.

A further aspect of the present invention relates to a watch which comprises a watch glass according to the invention. Said watch is associated with the advantages described with regard to the watch glass according to the invention. The watch according to the invention may be of thin form through the use of a single watch glass and provides a high-quality optical effect since the gemstones are instantly and directly visible from a plurality of viewing angles. The highly prominent position of the gemstones imparts a completely new character and recognition value to the watch, which, as a hallmark of the watch, may be of high value.

Further details, advantages and features of the present invention will emerge from the following description of exemplary embodiments on the basis of the drawing, in which identical or functionally identical parts are denoted in each case by the same reference signs, and in which:

DETAILED DESCRIPTION

A watch glass 1 according to a first exemplary embodiment of the present invention will be described in detail below with reference to FIGS. 1 and 2.

Figure 1:
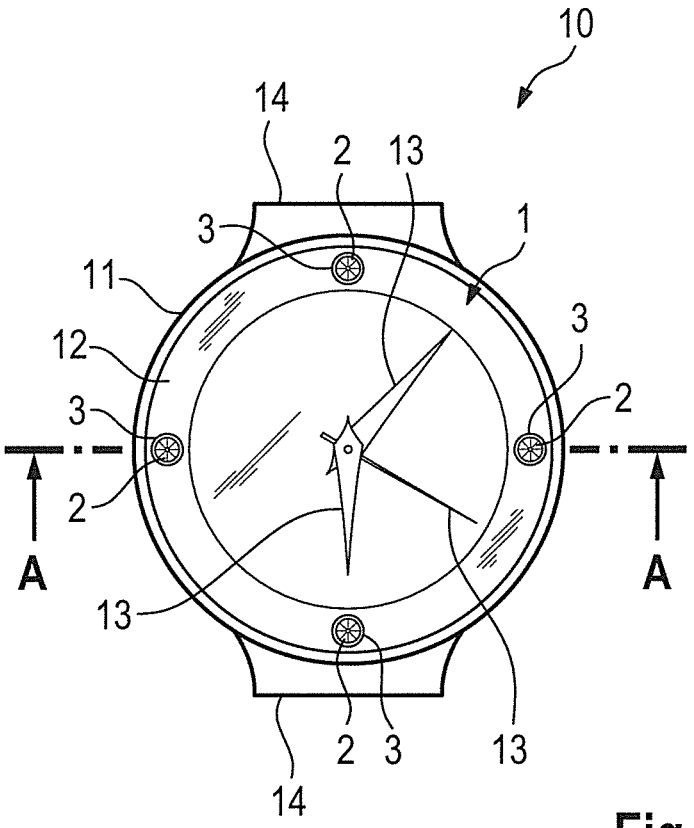
FIG. 1 shows a plan view of a watch, which comprises a watch glass with diamonds.

FIG. 1 shows a watch 10 in the form of a wristwatch with a housing 11 and with a watch glass 1 according to the invention, which watch glass is arranged in the housing 11 and is provided with gemstones 2. The gemstones 2 are in each case held in a setting 3. The housing 11 and the watch glass 1 are of circular form, but may have any other shape, such as for example the shape of a rectangle, a polygon, etc. In particular, in this case there are arranged in the watch glass 1 four gemstones 2, illustrated as diamonds, with a constant radius and at an equal distance from one another in the circumferential direction. The position and the number of the gemstones 2 may be selected in any desired manner, depending on the watch design. It is thus for example equally possible to install one gemstone, two gemstones or twelve gemstones into the watch glass 1. The watch 10 furthermore has a face 12, which is formed for example from gold leaf, and also three hands 13 for the indication of the hours, minutes and seconds, and two connectors for a strap 14.

Figure 2:
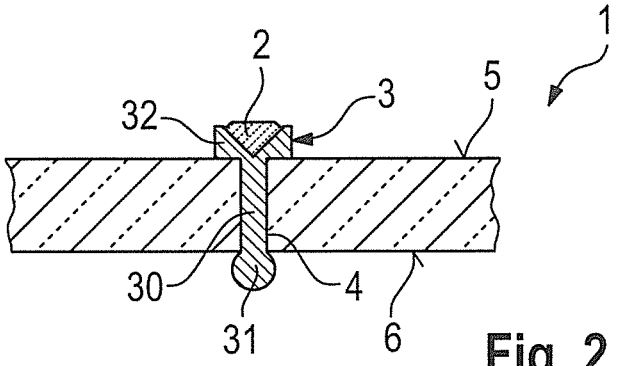
FIG. 2 shows a highly simplified, schematic sectional view of a region of the watch glass from FIG. 1 according to a first exemplary embodiment of the present invention.

FIG. 2 is a highly simplified, schematic view of a section A-A of a region of the watch glass 1 from FIG. 1. The setting 3 has a receptacle region 32 in which the gemstone 2 is accommodated and is provided with a pin-shaped projection 30. The setting 3, which is formed from gold, platinum or some other resistant material, may be produced together with the pin-shaped projection 30. Alternatively, the setting 3 may be soldered onto the pin-shaped projection 30.

The pin-shaped projection 30 is inserted into a continuous recess 4 of the watch glass 1, which recess formed as a bore of circular cross section. The receptacle region 32 of the setting 3 is arranged completely on a surface 5 of the watch glass 1. For the purpose of fastening the setting 3 to the watch glass 1, the pin-shaped projection 30 is riveted at its end. The reference sign 31 denotes a rivet head which is formed during the riveting process. Additionally, the setting 3 and the pin-shaped projection 30 may be pressed together, for example by means of riveting tongs. The projection 30 consequently becomes shorter and bulged in the recess 4 which, in particular, has a rough inner surface produced by way of the drilling process. This ensures secure fastening of the projection 30 to the watch glass 1 and also tightness of the recess 4.

Figure 3:
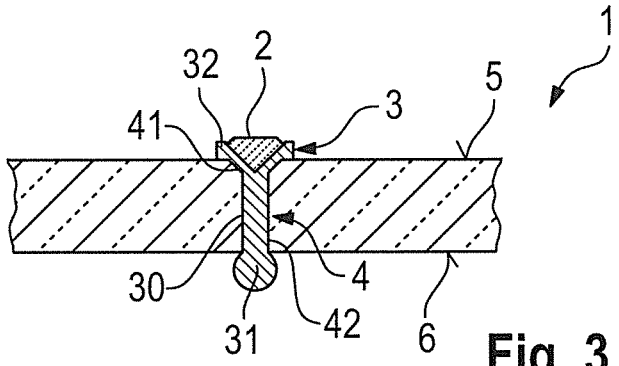
FIG. 3 shows a highly simplified, schematic sectional view of a region of a watch glass according to a second exemplary embodiment of the present invention.

FIG. 3 shows a second embodiment of the watch glass 1 according to the invention. In this case, the recess 4 is likewise formed in a continuous manner. However, the recess 4 is of two-step form and has a first cross-sectional region 41 and a second cross-sectional region 42. In particular, the first cross-sectional region 41 is of tapered form, and the second cross-sectional region 42 is formed as a cylindrical bore. Furthermore, the first cross-sectional region 41 is arranged on the surface 5 of the watch glass 1. The receptacle region 32 of the setting 3, which setting has a funnel-shaped geometry matching the recess 4, is arranged partially in the first cross-sectional region 41 of the recess 4 and partially on the surface 5 of the watch glass 1.

Figure 4:
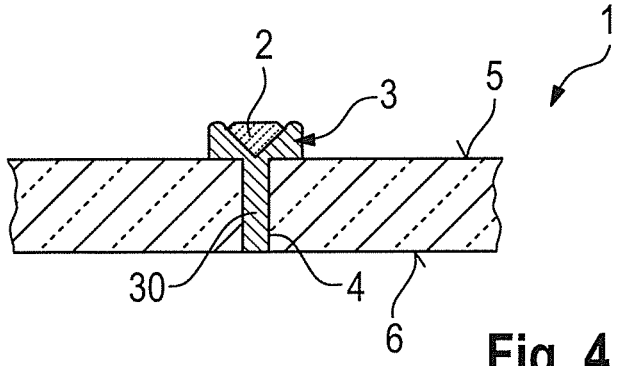
FIG. 4 shows a highly simplified, schematic sectional view of a region of a watch glass according to a third exemplary embodiment of the present invention.
Figure 5:
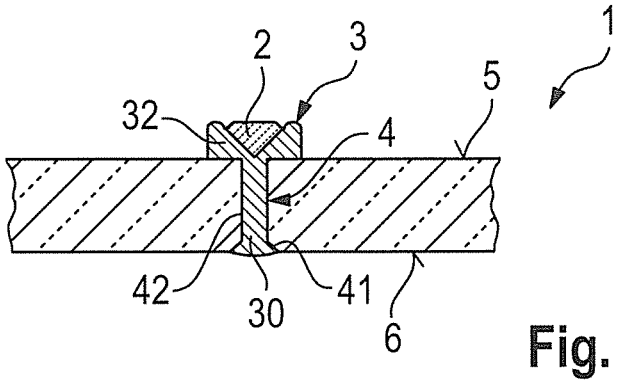
FIG. 5 shows a highly simplified, schematic sectional view of a region of a watch glass according to a fourth exemplary embodiment of the present invention.

As can be seen from FIG. 4, the watch glass 1 according to the third exemplary embodiment differs from the watch glasses 1 of the first two exemplary embodiments in that the pin-shaped projection 30 is formed to be flush with the bottom side 6 of the watch glass 1. Consequently, the structural size of the watch 10 can be reduced. A further difference is that the projection 30 is adhesively bonded to the watch glass 1 in the recess 4. One advantage of this type of fastening is that the gemstone 2 can already be held in the setting 3 before the setting 3 is adhesively bonded into the watch glass 1. Thus, simple handling and precise positioning of the gemstone 2 in the setting 3 is made possible.

Alternatively, the setting 3 and the pin-shaped projection 30 may be compressed such that the projection 30 spreads in the recess 4, and a form-fitting and force-fitting connection between the projection 30 and the watch glass 1 is thus produced. In the context of the invention, this corresponds to riveting of the pin-shaped projection 30.

In the case of the watch glass 1 according to the fourth embodiment of the present invention, the recess 4 is of two-step form, wherein the first cross-sectional region 41 is arranged on the bottom side 6 of the watch glass 1. For the purpose of fastening the setting 3 to the watch glass 1, the setting 3 is pressed so that the pin-shaped projection 30 is riveted in the first cross-sectional region 41. As a result, the projection 30 in the recess 4 is connected to the watch glass 1 in a form-fitting and force-fitting manner. In the fully manufactured state of the watch glass 1, the projection 30 is flush with the bottom side 6 of the watch glass 1.

Figure 6:
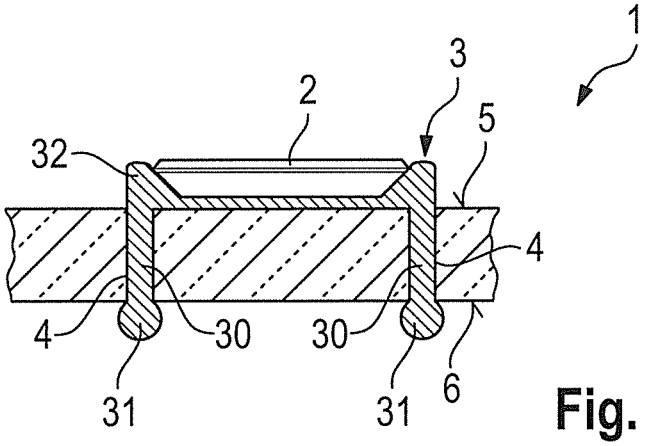
FIG. 6 shows a highly simplified, schematic sectional view of a region of a watch glass according to a fifth exemplary embodiment of the present invention.
Figure 7:
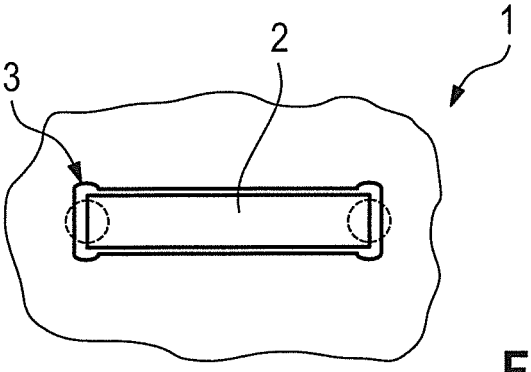
FIG. 7 shows a schematic plan view of the region of the watch glass of FIG. 6.

In order to use relatively large gemstones in the watch glass 1, the setting 3 according to a fifth exemplary embodiment of the invention may have a plurality of pin-shaped projections 30, as is shown in FIGS. 6 and 7. Correspondingly, the watch glass 1 has a plurality of recesses 4 into which the pin-shaped projections 30 are inserted. The fastening of the setting 3 to the watch glass 1 is ensured by riveting of the projections 30. The receptacle region 32 of the setting 3 is arranged on the surface 5 of the watch glass 1.

Figure 8:
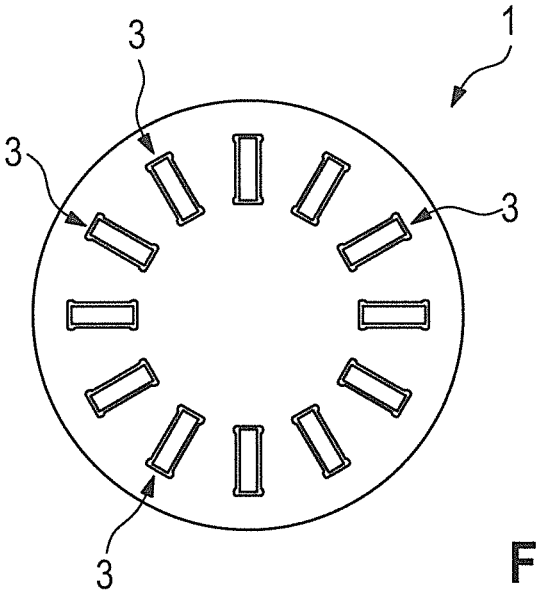
FIG. 8 shows a schematic plan view of the watch glass from FIGS. 6 and 7, in which a plurality of settings with gemstones is provided.

FIG. 8 shows the entire watch glass 1 of FIGS. 6 and 7, in which twelve gemstones 2 are arranged by means of settings 3. The settings 3 are arranged such that the settings 3 are assigned to the times. Said arrangement provides a uniform and elegant appearance of the watch glass 1 and thus simplifies the telling of the time.

Figure 9:
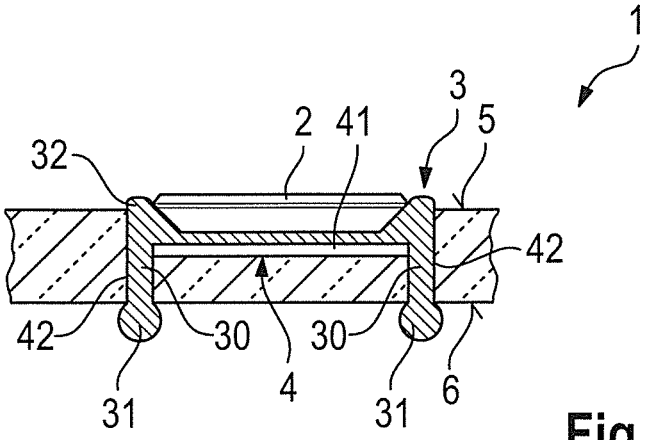
FIG. 9 shows a highly simplified, schematic sectional view of a region of a watch glass according to a sixth exemplary embodiment of the present invention.

FIG. 9 illustrates a sixth configuration according to the invention of the watch glass 1 of the present invention. In said exemplary embodiment, the setting 3 is sunk in the recess 4, as a result of which even larger gemstones may be used without the entire structural height of the watch glass 1 becoming too large. The receptacle region 32 of the setting 3 is situated freely in the recess 4.

Figure 10:
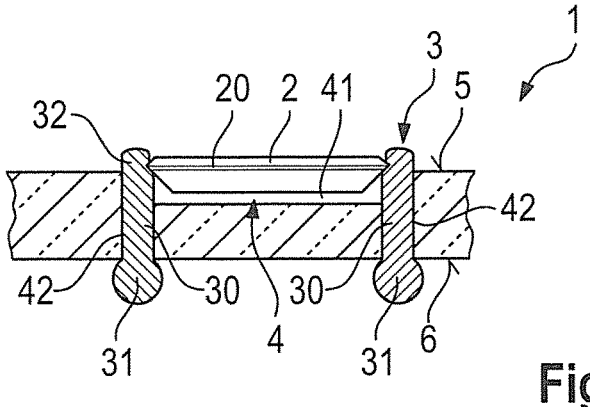
FIG. 10 shows a highly simplified, schematic sectional view of a region of a watch glass according to a seventh exemplary embodiment of the present invention.

A seventh configuration according to the invention of the watch glass 1 (FIG. 10) provides a setting 3 which is formed in such a way that the gemstone 2 is held via its girdle 20. This imparts a high-quality appearance to the watch glass since the gemstone can be viewed from a plurality of viewing angles.

Figure 11:
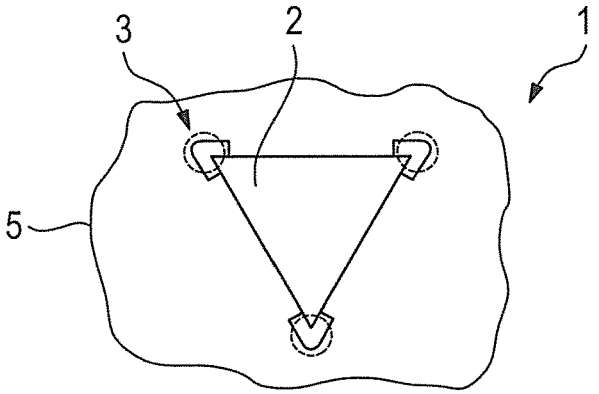
FIG. 11 shows a highly simplified, schematic sectional view of a region of a watch glass according to an eighth exemplary embodiment of the present invention.

FIG. 11 shows a plan view of a watch glass 1 of an eighth embodiment of the present invention. Arranged in the watch glass 1 are three recesses 4 which serve to accommodate three pin-shaped projections 30 of a triangular setting 3. The pin-shaped projections 30 may be fastened to the watch glass 1 by means of riveting and/or adhesive bonding.

In the context of the invention it is also possible to combine the already described embodiments of the watch glass 1 according to the invention.

Figure 12:
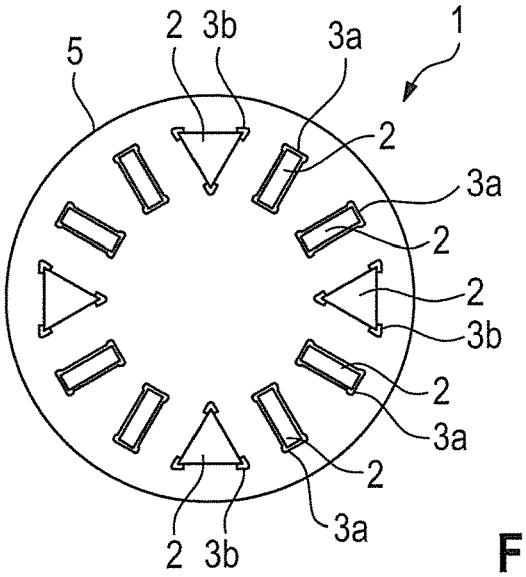
FIG. 12 shows a schematic plan view of a watch glass according to a ninth exemplary embodiment of the present invention, which has a plurality of settings with gemstones.

Correspondingly, FIG. 12 shows a watch glass 1 according to a ninth exemplary embodiment of the invention, which has a plurality of elongate settings 3*a*, for example according to FIGS. 6 to 8, and a plurality of triangular settings 3*b*, for example according to FIG. 11.

In addition to the above written description of the invention, reference is hereby explicitly made to the diagrammatic illustration of the invention in FIGS. 1 to 12 for additional disclosure thereof.

Various features of the invention are set forth in the following claims.

The invention claimed is:

1. A watch comprising:

a gemstone;

a setting which has a receptacle region in which the gemstone is accommodated and a cylindrical pin-shaped projection having a solid circular cross-section and extending therefrom; and a watch glass including a continuous recess in which at least the pin-shaped projection of the setting is arranged, wherein the pin-shaped projection is fastened to the watch glass via an adhesive bond between the pin-shaped projection and the watch glass, wherein the continuous recess extends from a topmost surface of the watch glass to a bottommost surface of the watch glass, and wherein the receptacle region extends radially outward beyond the continuous recess into abutment with the topmost surface of the watch glass.

2. The watch of claim 1, wherein the pin-shaped projection of the setting extends beyond a bottom side of the watch glass.

3. The watch of claim 2, wherein the pin-shaped projection of the setting is riveted.

4. The watch of claim 1, wherein the pin-shaped projection of the setting is riveted.

5. The watch of claim 4, wherein the recess has a first cross-sectional region and at least one second cross-sectional region, wherein the first cross-sectional region has a larger cross section than the second cross-sectional region.

6. The watch of claim 1, wherein the recess has a first cross-sectional region and at least one second cross-sectional region, wherein the first cross-sectional region has a larger cross section than the second cross-sectional region.

7. The watch of claim 6, wherein the first cross-sectional region is of conical form, and the second cross-sectional region is of pin-shaped form.

8. The watch of claim 7, wherein the setting is arranged at least partially in the first cross-sectional region of the recess, and the pin-shaped projection is arranged at least partially in the second cross-sectional region of the recess.

9. The watch of claim 6, wherein the setting is sunk into the first cross-sectional region of the recess.

10. The watch of claim 9, wherein the first cross-sectional region is arranged on a top side of the watch glass.

11. The watch of claim 6, wherein the setting is arranged at least partially in the first cross-sectional region of the recess, and the pin-shaped projection is arranged at least partially in the second cross-sectional region of the recess.

12. The watch of claim 6, wherein the first cross-sectional region is arranged on a top side or on a bottom side of the watch glass.

13. The watch of claim 1, wherein the pin-shaped projection is one of a plurality of pin-shaped projections, and a plurality of recesses is arranged in the watch glass, wherein the pin-shaped projections are in each case arranged in one recess.

14. The watch of claim 1, wherein the setting is produced together with the pin-shaped projection.

15. The watch of claim 1, wherein the setting is soldered onto the pin-shaped projection.

16. The watch of claim 1, wherein the continuous recess is a bore of circular cross-section.

17. The watch of claim 16, wherein the pin-shaped projection extends through the bore.

18. The watch of claim 1, wherein the pin-shaped projection is formed to be flush with a bottom side of the watch glass.

19. The watch of claim 1, further comprising a housing positioned below the watch glass and in which the watch glass is arranged, wherein the pin-shaped projection extends from the receptacle region, through the watch glass, and terminates prior to the housing.

20. The watch of claim 1, wherein the continuous recess is a first continuous recess extending from the topmost surface of the watch glass to the bottommost surface of the watch glass, the watch further comprising a second continuous recess spaced apart from the first continuous recess and extending from the topmost surface of the watch glass to the bottommost surface of the watch glass, wherein the pin-shaped projection is a first pin-shaped projection extending from the receptacle region, the watch further comprising a second pin-shaped projection spaced apart from the first pin-shaped projection and extending from the receptacle region, wherein the first pin-shaped projection of the setting is arranged within the first continuous recess and the second pin-shaped projection of the setting is arranged within the second continuous recess, wherein the first and second pin-shaped projections are fastened to the watch glass via an adhesive bond between the respective first and second pin-shaped projections and the watch glass.

21. The watch glass of claim 1, wherein the continuous recess extends from the topmost surface of the watch glass, and wherein the receptacle region is arranged completely on the topmost surface and the pin-shaped projection extends from the receptacle region at the topmost surface and into the continuous recess.

22. The watch glass of claim 1, wherein the gemstone is positioned within the receptacle region such that the gemstone does not extend below the topmost surface of the watch glass.

23. A watch comprising:

a gemstone;

a setting which has a receptacle region in which the gemstone is accommodated and a cylindrical pin-shaped projection having a solid circular cross-section and extending therefrom; and a watch glass including a continuous recess in which at least the pin-shaped projection of the setting is arranged, wherein the pin-shaped projection is fastened to the watch glass via an adhesive bond between the pin-shaped projection and the watch glass, wherein the continuous recess extends from a topmost surface of the watch glass, and wherein the receptacle region has a diameter greater than any diameter of the continuous recess.

24. A watch comprising:

a gemstone;

a setting which has a receptacle region in which the gemstone is accommodated and a cylindrical pin-shaped projection having a solid circular cross-section and extending therefrom; and a watch glass including a continuous recess in which at least the pin-shaped projection of the setting is arranged, wherein the pin-shaped projection is fastened to the watch glass via an adhesive bond between the pin-shaped projection and the watch glass, wherein the receptacle region includes an upper surface in contact with the gemstone and a lower surface in contact with a topmost surface of the watch glass.

* * * * *